United States Patent [19]

Braun

[11] 4,201,493

[45] May 6, 1980

[54] VIBRATING ROLLER

[76] Inventor: Günther Braun, Haubahn 26, 56 Wuppertal 1, Fed. Rep. of Germany

[21] Appl. No.: 3,393

[22] Filed: Jan. 12, 1979

[30] Foreign Application Priority Data

Jan. 25, 1978 [DE] Fed. Rep. of Germany ..... 2803172

[51] Int. Cl.[2] ..... E01C 19/38

[52] U.S. Cl. ..... 404/117; 404/122; 180/20; 74/674

[58] Field of Search ..... 404/122, 132, 117; 180/20, 24.09; 74/674, 710, 705

[56] References Cited

U.S. PATENT DOCUMENTS

| | | | |
|---|---|---|---|
| 1,113,101 | 10/1914 | Chase | 180/20 |
| 1,237,634 | 8/1917 | Gratton | 404/122 |
| 1,292,273 | 1/1919 | Downey | 180/20 |
| 1,375,185 | 4/1921 | Seiter | 404/132 X |
| 1,902,374 | 3/1933 | Pirinoli | 74/674 X |
| 2,096,911 | 10/1937 | Moore | 404/122 X |
| 2,101,150 | 12/1937 | Moore | 404/122 X |
| 2,742,684 | 4/1956 | Rising | 180/24.09 |
| 2,761,332 | 9/1956 | Gray | 74/674 |
| 3,060,818 | 10/1962 | Roberts | 404/122 |
| 3,161,250 | 12/1964 | Gardner | 404/132 X |
| 3,192,839 | 7/1965 | Vivier | 404/117 |
| 3,195,429 | 7/1965 | Cowley | 404/117 |
| 3,283,841 | 11/1966 | Davis | 404/122 X |
| 3,298,292 | 1/1967 | Wylie | 404/122 |
| 3,318,210 | 5/1967 | Schwamborn | 404/132 |
| 4,089,616 | 5/1978 | Fairchild | 404/117 |

FOREIGN PATENT DOCUMENTS

| | | |
|---|---|---|
| 1963767 | 7/1970 | Fed. Rep. of Germany . |
| 1459681 | 3/1972 | Fed. Rep. of Germany . |
| 1130537 | 2/1957 | France . |
| 531259 | 1/1941 | United Kingdom . |
| 1133284 | 11/1968 | United Kingdom . |
| 1237956 | 7/1971 | United Kingdom . |

*Primary Examiner*—Nile C. Byers, Jr.

*Attorney, Agent, or Firm*—Laney, Dougherty, Hessin & Beavers

[57] ABSTRACT

A vibrating roller is provided comprising a frame with a roller barrel mounted in the frame. The roller barrel includes first and second partial roller barrels, said first partial roller barrel including a central hollow shaft fixed thereto and extending axially therefrom. The second partial roller barrel is rotatingly mounted on said hollow shaft. A rotating unbalanced body is disposed in said hollow shaft for imparting vibratory motion to the first and second partial roller barrels. A prime mover is mounted on the frame, and drives the first and second partial roller barrels through a differential gear assembly. The differential gear assembly includes an externally toothed ring gear which is driven by a driving pinion which itself is drivingly connected to the prime mover. Connected to the externally toothed ring gear are a plurality of beveled pinion gears arranged to rotate about radial axes. First and second driven members of the differential gear assembly include first and second beveled ring gears, respectively. Said first and second beveled ring gears each mesh with said plurality of double pinion gears so that said first and second driven members are driven by the rotation of the externally toothed ring gear. The beveled pinion gears act as compensating gears allowing said first and second driven members to rotate at different speeds. The first driven member is connected to the hollow shaft of the first partial roller barrel by a first resilient force transmitting means. The second driven member is connected to the second partial roller barrel by a second resilient force transmitting means. At an end opposite said differential gear assembly, the hollow shaft is connected to a bearing structure which is in turn connected to the frame through a resilient mounting means.

18 Claims, 1 Drawing Figure

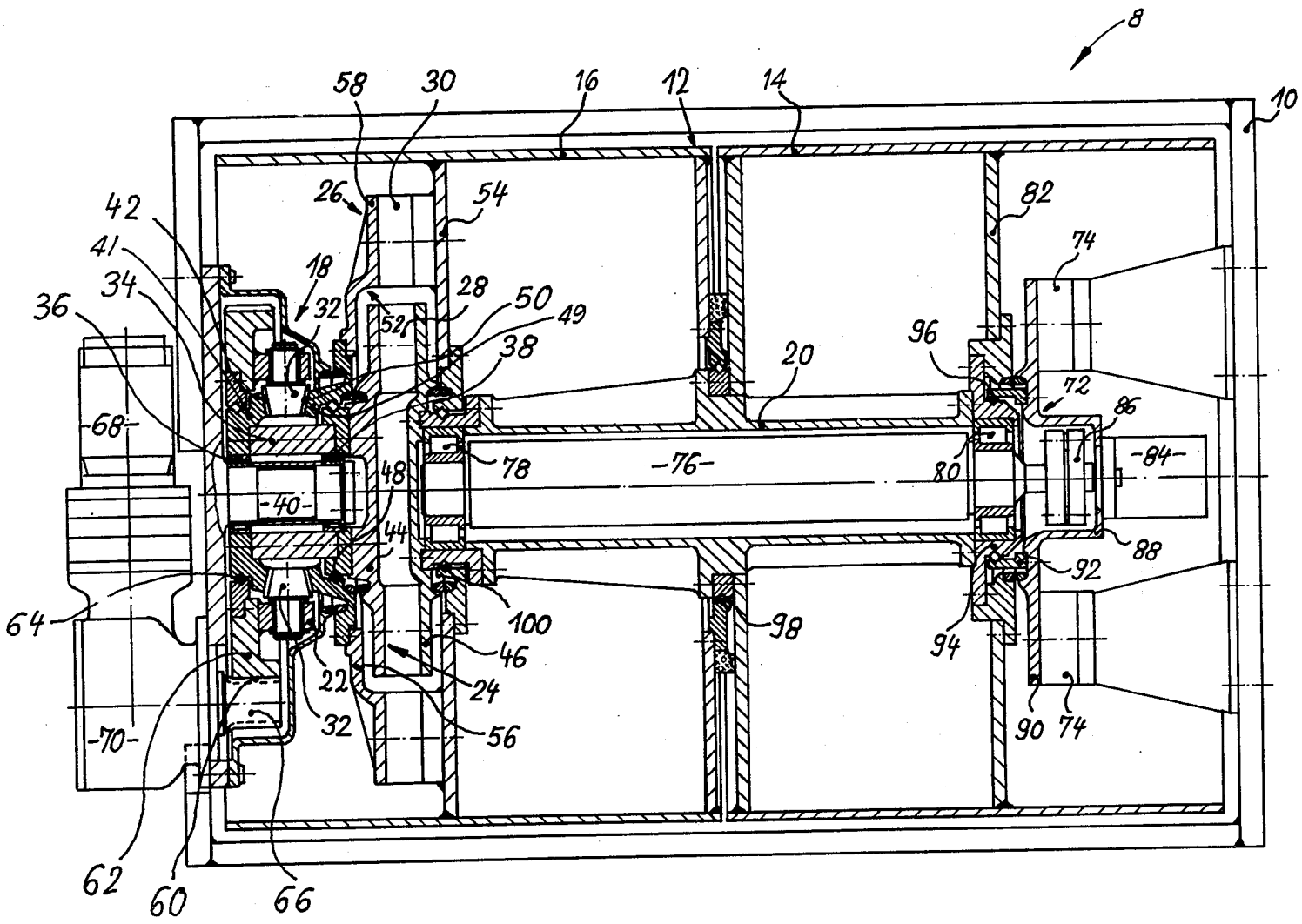
8
10
12
14
16
18
20
22
24
26
28
30
32
34
36
38
40
41
42
44
46
48
49
50
52
54
56
58
60
62
64
66
68
70
72
74
76
78
80
82
84
86
88
90
92
94
96
98
100

VIBRATING ROLLER

BACKGROUND OF THE INVENTION

1. Field of the Invention

This invention relates generally to vibrating rollers and more particularly, but not by way of limitation, to a vibrating roller having first and second partial roller barrels driven through a differential, said differential including a driving member and first and second driven members coupled to said first and second partial roller barrels, respectively.

2. Description of the Prior Art

German Patent specification laid open No. 1,459,681 discloses a vibrating roller wherein the roller barrel is subdivided into two partial roller barrels. Both partial roller barrels are mounted on a driving shaft, which is formed as a hollow shaft. A differential gear assembly is provided between the inner barrel bottoms of the two partial roller barrels. This differential gear assembly comprises a driving disk rigidly connected to the driving shaft and serving as a driving member. Compensating gears in the form of bevel gears are mounted on the driving disk for rotation about radial axes.

The compensating beveled gears mesh with first and second beveled ring gears which are connected to the barrel bottoms of the first and second partial roller barrels, respectively. The first and second beveled ring gears form the driven members of the differential gear assembly. An unbalanced body is rotatably mounted within the hollow shaft and is driven by an internal combustion engine through a chain or belt transmission.

The driving shaft of the vibrating roller of German Patent specification laid open No. 1,459,681 carries a gear which is driven by a hydraulic motor through a driving pinion gear. Steering of the vibrating roller is achieved by optionally braking one or the other of said partial roller barrels by means of a braking device.

The vibrating roller of German Patent specification laid open No. 1,459,681 suffers from a disadvantage. The vibratory motion created by the rotating unbalanced body is transmitted not only to the first and second partial roller barrels where it is needed, but also to the differential gear assembly and the hydraulic motor. This results in undesirable stress on all the components of the vibrating roller, and also increases the mass which must be vibrated by the rotating unbalanced body.

British Pat. No. 1,224,652 discloses a vibrating roller wherein a disk is rotatably mounted on the roller frame and is driven through a ring provided with internal teeth. The ring is driven by a pinion drive gear which itself is drivingly connected to a drive motor. The disk is connected to one barrel bottom of a single roller barrel through resilient force transmitting members in the form of rubber bodies or a rubber ring. The barrel bottoms of the roller barrel are mounted on a tubular axle. A solid axle is attached on one side to the roller frame and extends through the tubular axle. The tubular and solid axles have radial flanges at their ends remote from the driving side, said flanges being interconnected through rubber bodies. A vibration generator is provided on the tubular axle.

With the construction of British Pat. No. 1,224,652, the roller barrel is driven by the disk through the resilient force transmitting members. These resilient force transmitting members between the disk and the barrel bottom, and the rubber bodies between the flanges of the hollow shaft and of the solid shaft, permit vibratory motion of the roller barrel which motion is initiated by the vibration generator connected to the hollow shaft. The driving transmission members such as the drive motor, the driving pinion and the internal toothed ring gear are not, however, subjected to this vibratory motion, as those components are insulated from the hollow shaft by the resilient force transmitting members and the rubber bodies between the flanges.

SUMMARY OF THE INVENTION

A vibrating roller is provided comprising a frame with a roller barrel mounted in the frame. The roller barrel includes first and second partial roller barrels, said first partial roller barrel including a central hollow shaft fixed thereto and extending axially therefrom. The second partial roller barrel is rotatingly mounted on said hollow shaft. A rotating unbalanced body is disposed in said hollow shaft for imparting vibratory motion to the first and second partial roller barrels. A prime mover is mounted on the frame, and drives the first and second partial roller barrels through a differential gear assembly. The differential gear assembly includes an externally toothed ring gear which is driven by a driving pinion which itself is drivingly connected to the prime mover. Connected to the externally toothed ring gear are a plurality of beveled pinion gears arranged to rotate about radial axes. First and second driven members of the differential gear assembly include first and second beveled ring gears, respectively. Said first and second beveled ring gears each mesh with said plurality of beveled pinion gears so that said first and second driven members are driven by the rotation of the externally toothed ring gear. The beveled pinion gears act as compensating gears allowing said first and second driven members to rotate at different speeds. The first driven member is connected to the hollow shaft of the first partial roller barrel by a first resilient force transmitting means. The second driven member is connected to the second partial roller barrel by a second resilient force transmitting means. At an end opposite said differential gear assembly, the hollow shaft is connected to a bearing structure which is in turn connected to the frame through a resilient mounting means.

In this manner, a vibrating roller barrel is provided having first and second partial roller barrels driven by a compensating differential gear assembly. The vibrations of the first and second partial roller barrels are isolated from the frame of the vibrating roller and from the prime mover and the differential gear assembly so as to prevent unnecessary stress on those components.

It is, therefore, a general object of the present invention to provide an improved vibrating roller.

Another object of the present invention is the provision of a roller having a first and second partial roller barrels, said first partial roller barrel including an axially extending shaft upon which said second partial roller barrel is rotatingly mounted.

Another object of the present invention is to provide a vibrating roller having a roller barrel subdivided into first and second partial roller barrels and driven by a differential gear assembly, said vibrating roller being so constructed that the differential gear assembly is isolated from the vibratory motion of the roller barrel.

Other and further objects, features and advantages of the present invention will be readily apparent to those skilled in the art upon a reading of the description of the preferred embodiments which follows when taken in conjunction with the accompanying drawing.

BRIEF DESCRIPTION OF THE DRAWING

The FIGURE illustrates a partially sectional plan view of the vibrating roller of the present invention.

DETAILED DESCRIPTION OF THE PREFERRED EMBODIMENTS

Referring now to the drawing, the vibrating roller of the present invention is shown and generally designated by the number 8. The vibrating roller 8 includes a vehicle frame 10 in which is mounted a roller barrel 12. The roller barrel 12 is subdivided into first and second partial roller barrels or rollers 14 and 16, respectively.

First and second partial roller barrels 14 and 16 are axially aligned and mounted closely adjacent one to the other.

A differential gear assembly 18 is mounted on vehicle frame 10 for driving first and second partial roller barrels 14 and 16. The first partial roller barrel 14 has fixedly attached thereto a hollow shaft 20 which projects axially outward to one side from first partial roller barrel 14. The second partial roller barrel 16 is rotatingly mounted upon the shaft 20.

The differential gear assembly 18 includes a driving member 22 and first and second driven members 24 and 26, respectively. The first and second driven members 24 and 26 are connected to the shaft 20 of the first partial roller barrel 14, and to the second partial roller barrel 16, respectively, through first and second resilient force transmitting members 28 and 30, respectively.

The driving member 22 is an annular ring, in which a plurality of beveled pinion gears 32, which act as compensating gears, are mounted. The beveled pinion gears 32 rotate about axes extending radially from the axis of rotation of shaft 20.

The first driven member 24 includes a hub assembly 34 which is rotatably mounted through bearings 36 and 38 on a stub axle 40 which extends axially inward from the vehicle frame 10. The hub assembly 34 includes a first beveled ring gear 41 having gear teeth 42 meshing with the teeth of the beveled pinion gears 32. First driven member 24 further includes a radially extending flange 44. Hollow shaft 20 includes a radially extending flange 46. The flange 44 of first driven member 24 is connected to the flange 46 of the shaft 20 through the rubber bodies 28 which act as resilient force transmitting members. The resilient force transmitting member 28 may also comprise an annular ring rather than a plurality of rubber bodies.

The second driven member 26 is rotatably mounted upon the first driven member 24 by means of a crossed roller bearing 48. Second driven member 26 drivingly connects driving member 22 and the roller barrel 12. Second driven member 26 includes a second beveled ring gear portion 49 having a plurality of teeth 50 which mesh with the teeth of the beveled pinion gears 32 on the side of said gears 32 adjacent the roller barrel 12. Driven member 26 also includes a flange 52 which extends radially beyond the flange 44 of the first driven member 24. The flange 52 is connected to a barrel bottom 54 of the second partial roller barrel 16 through the rubber bodies 30 which act as resilient force transmitting members.

The flange 52 of the second driven member 26 includes a dish-shaped central portion 56 and a plane radially extending edge portion 58. The dish-shaped central portion 56 extends over the flange 44 of the first driven member 24, and the plane radially extending edge portion 58, which is connected to the rubber bodies 30, is located substantially in the same plane as the flange 44 of the first driven member 24.

The driving member 22 is connected to a ring gear 62 which has a plurality of external teeth 60. The ring gear 62 and ring 22 are rotatingly mounted on the first driven member 24 through a crossed roller bearing 64. The teeth 60 of ring gear 62 mesh with a driving pinion 66. The driving pinion 66 is mounted in the vehicle frame 10 and is driven by a hydraulic motor 68 through a beveled gearing drive assembly 70.

The first partial roller barrel 14 is mounted, at its end or side remote from the differential gear assembly 18, in a bearing member 72. The bearing member 72 is connected to the vehicle frame 10 by resilient mounting means 74 which serve to isolate the vehicle frame 10 from the vibratory motion of the first partial roller barrel 14. The tubular shaft 20 of the first partial roller barrel 14 extends through the first partial roller barrel 14 and extends axially outward therefrom toward the differential gear assembly 18.

A driven unbalanced body 76 is mounted within tubular shaft 20 in bearings 78 and 80. The bearings 78 and 80 are anti-friction bearings, which are located substantially in the planes of the axially outer barrel bottoms 82 and 54, respectively, of the first and second partial roller barrels 14 and 16, respectively. Barrel bottoms 82 and 54 may be referred to as radially extending structural members. A hydraulic motor 84 is provided on the bearing member 72 and is coupled to the unbalanced body 76 through a resilient coupling 86.

The bearing member 72 has a pot-shaped central portion 88 open towards the shaft 76. A flange 90 extends radially outward from the central portion 88 and a bearing ring 92 projects axially inward from the central portion 88. The hydraulic motor 84 is located on the axially outer end of the central portion 88 and the resilient coupling 86 is arranged in the interior of the pot-shaped central portion 88.

The rubber bodies or resilient mounting means 74, for mounting the bearing member 72, are connected to the flange 90.

The first partial roller barrel 14 includes a hub 94 extending axially therefrom into the bearing ring 92. The hub 94 is mounted in the bearing ring 92 through a crossed roller bearing 96. The anti-friction bearing 80 is arranged in the hub 94, and the crossed roller bearing 96 is arranged in the central radially extending plane of the anti-friction bearing 80. This central plane coincides substantially with the plane of the axially outer barrel bottom 82 of the first partial roller barrel Thus, there is a purely radially transmission of the bearing forces to the partial roller barrel 14 from the unbalanced rotating body 76.

The second partial roller barrel 16 is rotatingly mounted on the shaft 20 through crossed roller bearings 98 and 100. The shaft 20 is reinforced at the locations of each of the bearings 98 and 100.

Operation of the Vibrating Roller

The vibrating roller 8 of the present invention operates as follows. The locomoting force is provided by the prime mover or hydraulic motor 68. The externally toothed ring gear 62 and the connected driving member 22 are driven by driving pinion 66 from the prime mover 68. When the vibrating roller 8 is travelling straight ahead, the two driven members 24 and 26 are driven at equal angular speeds through the beveled pinion gears 32. In this mode of operation, the first and second driven member 24 are rotating at the same angular speed as the ring 22, and the beveled pinion gears 32 are not rotating about their radial axes.

The first partial roller barrel 14 is driven through the first resilient force transmitting member 28 and the shaft 20, while the second partial roller barrel 16 is driven through the second resilient force transmitting member 30. The unbalanced body 76 is driven by the hydraulic motor 84 and excites the first and second partial roller barrels 14 and 16 to vibratory motion through the anti-friction bearings 78 and 80 and the crossed roller bearings 98 and 100. This also causes the bearing member 72 to vibrate. Bearing member 72, however, is mounted on the vehicle frame 10 by the resilient mounting means 74. The differential gear assembly 18 is firmly attached to the vehicle frame 10. The vehicle frame 10, differential gear assembly 18, and the prime mover 68 and its associated drive gearing are all isolated from the vibratory motion of the roller barrel 12 by means of the resilient force transmitting members 28 and 30 and the resilient mounting means 74.

When the vibrating roller 8 is moving through a turn or other non-linear path, it is necessary for the one of said partial roller barrels 14 and 16, on the outer edge of said path, to rotate at a higher angular velocity than the other of said partial roller barrels on the inner edge of said path. During such maneuvers, the bevel pinion gears 32 act as compensating gears and allow the first and second partial roller barrels to turn at differing angular speeds, while at the same time, both of the first and second driven members 24 and 26 continue to be driven by the driving member 22.

Thus, the invention provides a vibrating roller 8 having a roller barrel 12, which is subdivided into first and second partial roller barrels 14 and 16, wherein the two partial roller barrels are driven by means of the differential gear assembly 18 such that the partial roller barrels 14 and 16 may be driven at different rotary speeds during turns. The differential gear 18 is, however, vibration insulated from the roller barrel 12 by means of rubber bodies 28 and 30.

Thus, the vibratory roller of the present invention is well adapted to carry out the objects and attain the ends and advantages mentioned as well as those inherent therein. While presently preferred embodiments of the invention have been described for the purpose of this disclosure, numerous changes in the construction and arrangement of parts can be made by those skilled in the art, which changes are encompassed within the spirit of this invention as defined by the appended claims.

What is claimed is:

1. A vibrating roller, comprising:

a frame;

a roller barrel, mounted in said frame, said roller barrel including first and second partial roller barrels, said first partial roller barrel including a central shaft fixed thereto, and said second partial roller barrel being rotatingly mounted on said shaft;

means, connected to said roller barrel, for imparting vibratory motion to said partial roller barrels;

a prime mover, mounted upon said frame;

a differential, mounted upon said frame, said differential including a driving member and first and second driven members, said driving member being drivingly connected to said prime mover; and first and second resilient force transmitting means, connecting said first and second driven members to said shaft of said first partial roller barrel and to said second partial roller barrel, respectively.

2. Apparatus of claim 1, wherein:

said driving member includes a ring having an axis of rotation parallel to an axis of rotation of said roller barrel, and further includes a plurality of bevel pinion gears connected to said ring for rotation about axes perpendicular to said axis of rotation of said ring;

said first driven member is rotatingly mounted on said frame about an axis parallel to said axis of rotation of said roller barrel, and includes a first beveled ring gear engaging said bevel pinion gears and further includes a radially projecting flange;

said second driven member is rotatably mounted on said first driven member, and includes a second beveled ring gear engaging said plurality of bevel pinion gears, and further includes a radially projecting flange extending radially beyond said flange of said first driven member;

said shaft of said first partial roller barrel includes a flange connected to said flange of said first driven member by said first resilient force transmitting means; and a barrel bottom of said second partial roller barrel is connected to said flange of said second driven member by said second resilient force transmitting means.

3. Apparatus of claim 2, wherein:

said driving member further includes a ring gear, connected to said ring to rotate therewith, and having a plurality of radially outer teeth meshing with a driving pinion gear which is driven by said prime mover, said driving member being rotatably mounted on said first driven member.

4. Apparatus of claim 2, wherein:

said flange of said second driven member includes a dish-shaped central portion and a planar radially extending edge portion, said dish-shaped central portion extending over the flange of said first driven member so that said planar edge portion is in substantially the same plane as the flange of said first driven member.

5. Apparatus of claim 1, wherein:

an end of said first partial roller barrel remote from said differential is rotatingly mounted within a bearing member, said bearing member being connected to said frame by resilient mounting means.

6. Apparatus of claim 5, wherein:

said shaft of said first partial roller barrel is tubular and a driven unbalanced body is rotatingly mounted within said shaft.

7. Apparatus of claim 6, wherein:

said unbalanced body is mounted within first and second bearings, said first and second bearings being located substantially in the planes of axially outer barrel bottoms of said first and second partial roller barrels, respectively.

8. Apparatus of claim 6, wherein:

a hydraulic motor is mounted upon said bearing member and is drivingly coupled to said unbalanced body.

9. Apparatus of claim 8, wherein:

said hydraulic motor is coupled to said unbalanced body by a resilient coupling.

10. Apparatus of claim 9, wherein:

said bearing member includes a pot-shaped central portion open towards said differential, a flange projecting radially outward from said central portion, and a bearing ring projecting axially inward toward said differential;

said hydraulic motor is mounted on an axially outer end of said central portion;

said resilient coupling is located in the interior of said central portion; and said flange of said bearing member is connected to said frame by said resilient mounting means.

11. A vibrating roller, comprising:

a frame;

a first partial roller barrel rotatingly connected to said frame, said first partial roller barrel including a central shaft extending axially therefrom;

a second partial roller barrel rotatingly mounted upon said shaft;

vibrator means, for imparting vibratory motion to said first and second partial roller barrels;

drive means, mounted upon said frame, for driving said first and second partial roller barrels while allowing one of said partial roller barrels to rotate at a rotational velocity different from a rotational velocity of the other of said partial roller; and first and second resilient force transmitting means connecting said drive means to said shaft of said first partial roller barrel and to said second partial roller barrel, respectively.

12. Apparatus of claim 11, wherein:

an end of said first partial roller barrel remote from said drive means is rotatingly connected to a bearing member, said bearing member being connected to said frame by a resilient mounting means, so that said frame is isolated from said vibratory motion of said partial roller barrels.

13. Apparatus of claim 11, wherein:

said shaft is a tubular shaft; and said vibrator means comprises a rotating unbalanced body disposed in said shaft.

14. Apparatus of claim 13, wherein:

said first and second partial roller barrels each include axially outer radially extending structural members; and said rotating unbalanced body is supported in first and second bearings, said first and second bearings being located approximately in the planes of said axially outer radially extending structural members of said first and second partial roller barrels, respectively.

15. Apparatus of claim 11, wherein said drive means comprises:

a rotating ring having connected thereto a plurality of bevel pinion gears, each of said bevel pinion gears freely rotating about axes of rotation extending radially from an axis of rotation of said shaft of said first partial roller barrel;

a first driven member, including a first beveled ring gear engaging said plurality of bevel pinion gears, said first driven member being connected to said shaft of said first partial roller barrel by said first resilient force transmitting means; and a second driven member, including a second beveled ring gear engaging said plurality of bevel pinion gears, said second driven member being connected to said second partial roller barrel by said second resilient force transmitting means.

16. Apparatus of claim 15, wherein:

said rotating ring is rotatingly mounted upon said first driven member.

17. Apparatus of claim 16, wherein:

said second driven member is rotatingly mounted on said first driven member.

18. Apparatus of claim 15, wherein:

said second driven member is rotatingly mounted on said first driven member.

* * * * *